US010297366B2

(12) United States Patent
Yao et al.

(10) Patent No.: US 10,297,366 B2
(45) Date of Patent: May 21, 2019

(54) ELECTRIC POWER CABLE

(71) Applicant: 3M INNOVATIVE PROPERTIES COMPANY, St. Paul, MN (US)

(72) Inventors: Xueyan Yao, Shanghai (CN); Zheng Guan, Shanghai (CN); Chongrui Cai, Shanghai (CN); Tiande Wang, Shanghai (CN); Yaming Wang, Shanghai (CN)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/526,964

(22) PCT Filed: Nov. 12, 2015

(86) PCT No.: PCT/US2015/060285
§ 371 (c)(1),
(2) Date: May 15, 2017

(87) PCT Pub. No.: WO2016/081264
PCT Pub. Date: May 26, 2016

(65) Prior Publication Data

US 2017/0330649 A1 Nov. 16, 2017

(30) Foreign Application Priority Data

Nov. 21, 2014 (CN) ..... 201420709242

(51) Int. Cl.
*H01B 9/00* (2006.01)
*H01B 3/46* (2006.01)
(Continued)

(52) U.S. Cl.
CPC ..... *H01B 9/008* (2013.01); *H01B 3/002* (2013.01); *H01B 3/46* (2013.01); *H01B 13/06* (2013.01); *H01B 5/08* (2013.01)

(58) Field of Classification Search
USPC ..... 174/118
See application file for complete search history.

(56) References Cited

U.S. PATENT DOCUMENTS 463,079 A * 11/1891 Snedekor ..... H01B 7/0063 174/118
1,722,118 A * 7/1929 Varney ..... H02G 7/14 248/63

(Continued)

FOREIGN PATENT DOCUMENTS

CN 102306522 1/2012
CN 103310915 9/2013

(Continued)

OTHER PUBLICATIONS

International Search Report for PCT International Application No. PCT/US2015/060285, dated Feb. 23, 2016, 3 pages.

(Continued)

*Primary Examiner* — William H Mayo, III
*Assistant Examiner* — Krystal Robinson
(74) *Attorney, Agent, or Firm* — Gregg H. Rosenblatt

(57) ABSTRACT

An electric power cable is provided, wherein the electric power cable comprises an organic silicon insulating coating layer capable of being cured at room temperature. Generally, the electric power cable comprises a cable conductor capable of transmitting electric energy, and the organic silicon insulating coating layer is coated to the exterior surface of the cable conductor. The cable conductor may be an exposed overhead bare conductive wire, and the organic silicon insulating coating layer is especially suitable for being formed on the exterior surface of the overhead bare conductive wire by coating directly thereto.

15 Claims, 1 Drawing Sheet

(51) Int. Cl.

| | |
|---|---|
| ***H01B 3/00*** | (2006.01) |
| ***H01B 13/06*** | (2006.01) |
| *H01B 5/08* | (2006.01) |

(56) References Cited

U.S. PATENT DOCUMENTS

| | | | | | |
|---|---|---|---|---|---|
| 2,132,319 | A * | 10/1938 | Preiswerk | H02G 7/14 | 138/103 |
| 2,714,585 | A * | 8/1955 | Agens | C08K 5/098 | 525/479 |
| 2,959,563 | A * | 11/1960 | Ettinger | C08K 3/34 | 524/442 |
| 3,406,384 | A * | 10/1968 | Hartman | G08B 17/06 | 337/416 |
| 3,445,586 | A * | 5/1969 | Mussen | H01B 5/00 | 174/130 |
| 3,566,009 | A * | 2/1971 | Lamond | H01B 7/16 | 174/116 |
| 3,600,221 | A * | 8/1971 | Hibbs, Jr. | B05D 7/14 | 148/518 |
| 3,659,038 | A * | 4/1972 | Shealy | H01B 5/08 | 174/128.1 |
| 4,439,255 | A * | 3/1984 | Imai | H01B 7/0208 | 156/155 |
| 4,659,871 | A * | 4/1987 | Smith | C08K 9/04 | 174/113 R |
| 5,115,103 | A | 5/1992 | Yamanishi et al. | | |
| 5,150,444 | A | 9/1992 | Bosisio | | |
| 5,243,137 | A * | 9/1993 | Gentry | H01B 5/104 | 156/50 |
| 5,455,881 | A | 10/1995 | Bosisio | | |
| 5,817,982 | A | 10/1998 | Arumugasaamy | | |
| 5,866,653 | A * | 2/1999 | Matsushita | C08K 5/0066 | 524/715 |
| 8,193,268 | B2 | 6/2012 | George | | |
| 2002/0036092 | A1* | 3/2002 | Kikuchi | H01B 5/104 | 174/40 R |
| 2007/0187130 | A1* | 8/2007 | Park | H02G 3/123 | 174/68.1 |
| 2016/0083862 | A1* | 3/2016 | Malshe | C25D 9/06 | 205/50 |

FOREIGN PATENT DOCUMENTS

| | | |
|---|---|---|
| CN | 103337278 | 10/2013 |
| CN | 203631211 | 6/2014 |
| CN | 103611645 | 11/2016 |
| EP | 0947528 | 10/1999 |

OTHER PUBLICATIONS

EP Search Report for Application No. 15860302.7, dated May 29, 2018, 4pgs.

* cited by examiner

ELECTRIC POWER CABLE

TECHNICAL FIELD

The present invention relates to an electric power cable, and more particularly to an electric power cable with an insulating coating layer. The present application claims priority to Utility Model 201420709242.3, incorporated by reference herein in its entirety.

BACKGROUND

At present, medium & low voltage power in China relies considerably on an overhead bare conductor (hereafter referred to as an overhead line) to transmit. But, as population density increases, the contradiction between urban buildings or thick green areas and overhead transmission lines of an urban power network is increasingly prominent. Because an uninsulated bare conductive wire is erected on a tower pole by means of a spatial distance and an insulator, many accidents often occur in both sides of an urban street, a housing district, and so on. To guarantee personal and property safety, State Grid Corporation of China now considers the need to achieve 100% overhead line insulation. For a new erected line, an insulated overhead line can be directly selected for use. A modern insulated overhead line is mainly made from cross-linked polyethylene and high-density polyethylene. For an exposed overhead line which has been erected in the past and still operates currently, insulation processing is also required, and will be replaced bit by bit with insulated overhead lines within the next few years. However, it will take a long time to remove an old exposed overhead line and reinstall a new insulated overhead line, and human and material resources invested in this process are costly, particularly in some remote, uneven areas with discrepancies between lines and houses, the cost of replacement with new lines is especially high.

Therefore, how to achieve the insulation processing in an existing exposed overhead line becomes an urgent problem to solve.

SUMMARY OF THE PRESENT INVENTION

One of the aims of the present invention is to provide an electric power cable with an insulating coating layer, and particularly, the electric power cable with an insulating coating layer can be formed by performing insulation processing on an existing exposed overhead line.

According to one aspect of the present invention, an electric power cable is provided, wherein the electric power cable comprises an organic silicon insulating coating layer capable of being cured at room temperature. Generally, the electric power cable comprises a cable conductor capable of transmitting electric energy, and optionally, the organic silicon insulating coating layer is coated to the exterior surface of the cable conductor. The cable conductor may be an exposed overhead bare conductive wire, and the organic silicon insulating coating layer is especially suitable for being formed on the exterior surface of the overhead bare conductive wire by coating directly thereto.

Optionally, the thickness of the organic silicon insulating coating layer is 1.5 to 3.0 mm, and more suitably, the thickness thereof is 2.0 to 2.5 mm.

Optionally, the organic silicon insulating coating layer is an organic silicon insulating coating layer containing hollow glass microspheres. Preferably, the hollow glass microspheres account for 30% to 40% of the total weight of the organic silicon insulating coating layer, and more suitably for 25% to 45% of the total weight. Preferably, the density of the hollow glass microspheres is 0.4 to 0.6 g/cm$^3$, and the average grain diameter of the hollow glass microspheres is 10 to 100 μm.

Different embodiments of the present invention respectively have at least one of the following beneficial effects: an insulated electric power cable different from those made from cross-linked polyethylene and high-density polyethylene is provided; and the electric power cable with an insulating coating layer can be formed by performing the insulation processing on an existing exposed overhead line, and the insulation of an overhead line also can be achieved by directly coating organic silicon insulating coating capable of being cured at room temperature to the existing exposed overhead line, such that the existing exposed overhead line can be directly upgraded and reformed, and compared with replacement with a new insulated overhead line, construction time can be shortened, costs can be saved, and power supply can be restored as soon as possible.

BRIEF DESCRIPTION OF THE DRAWINGS

To more clearly describe the technical solutions of the embodiments of the present invention, the drawings required to be used in the description of the embodiments will be simply presented. Obviously, the following drawings are merely examples to show some embodiments of the present invention, and for those skilled in the art, other drawings can also be obtained according to these drawings without carrying out creative work. In addition, these drawings should not be understood to be any limitation to the present invention.

DETAILED DESCRIPTION OF THE EMBODIMENTS

It should be noted that the following embodiments are examples to describe the present invention, and the features of different embodiments can be combined with each other when no conflict exists between them. The present invention will be described in detail by reference to the drawings and in conjunction with the specific embodiments.

Figure 1:
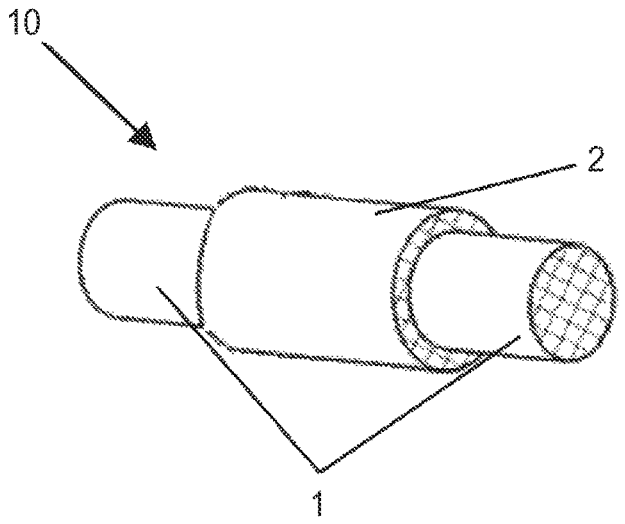
FIG. 1 shows an axial structural diagram of an electric power cable provided by the embodiments of the present invention.

FIG. 1 shows an axial structural diagram of an electric power cable provided by an embodiment of the present invention. An electric power cable 10 comprises a cable conductor 1 capable of transmitting electric energy and an organic silicon insulating coating layer 2 capable of being cured at room temperature, wherein the organic silicon insulating coating layer 2 is arranged on the exterior surface of the cable conductor 1.

Figure 2:
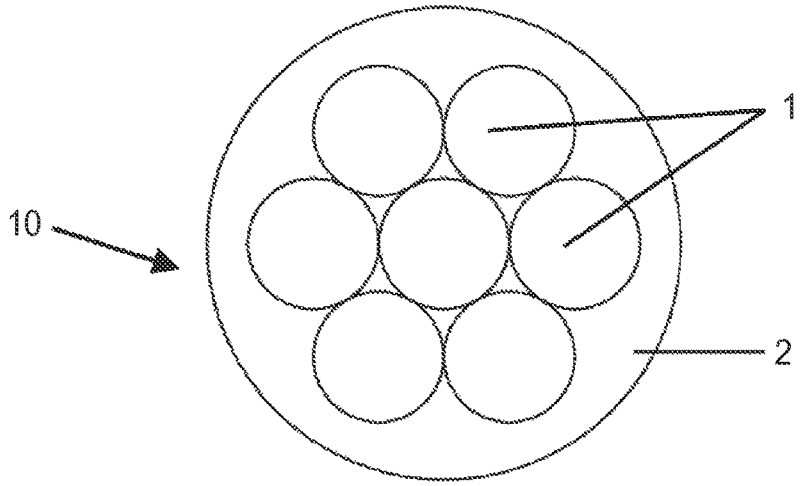
FIG. 2 shows a cross-section structural diagram of an electric power cable provided by the embodiments of the present invention.

It may be understood that the cable conductor 1 may be a single metal conductive wire, such as aluminum conductive wire or copper conductive wire; or the cable conductor 1 may also be formed by twisting a plurality of metal conductive wires together, for example, it is formed by twisting mono-layer or multi-layer aluminum stranded wires together. FIG. 2 is an example to show a cross-section structure of the electric power cable 10, wherein the cable conductor 1 is formed by twisting the plurality of metal conductive wires together.

To obtain a better insulating effect, in general, the organic silicon insulating coating layer 2 is evenly wrapped on the exterior surface of the cable conductor 1 so that the exterior surface of the electric power cable 10 is a roughly smooth cambered surface. The organic silicon insulating coating layer 2 can be formed by applying organic silicon insulating coating to the exterior surface of the cable conductor 1 via coating or spraying. Considering the insulating effect and the weight of the electric power cable, preferably, the thickness of the organic silicon insulating coating layer is 1.5 to 3.0 mm, and more suitably, the thickness of the organic silicon insulating coating layer is 2.0 to 2.5 mm. The thickness is the difference between the radius of the electric power cable 10 coated with the organic silicon insulating coating layer 2 and the maximum radius of the cable conductor 1. It may be understood that in the case where the cable conductor 1 is formed by twisting the plurality of metal conductive wires together, the exterior surface of the cable conductor 1 may not be a smooth round surface, but may be a wavy curved surface; therefore there may be a concave part between two metal conductive wires. When the organic silicon insulating coating layer 2 is formed, the organic silicon insulating coating will fill the concave part; and therefore the thickness of the organic silicon insulating coating layer coated at the concave part is clearly greater than the above-mentioned thickness of the organic silicon insulating coating layer.

The main material of the organic silicon insulating coating capable of being cured at room temperature used in the embodiments of the present invention may comprise hydroxyl silica gels, silane curing agents, fillers, catalysts, pigments, reinforcing agents, etc. The organic silicon insulating coating may be silicon rubber insulation material, such as 526, a product of 3M Company, obtained from commercial channels.

Besides, to achieve the lightening of an insulated cable, proportionally lighter material can be selected as the filler in the organic silicon coating capable of being cured at room temperature, preferably, such as hollow glass microspheres. So, the organic silicon insulating coating layer 2 preferably is an organic silicon insulating coating layer containing the hollow glass microspheres. It is found based on the inventors' study that when the hollow glass microspheres account for 25% to 45% of the total weight of the organic silicon insulating coating layer, and particularly, when the hollow glass microspheres account for 30% to 40% of the total weight of the organic silicon insulating coating layer, the insulated cable 100 may have better insulating and lightening properties. Preferably, the density of the hollow glass microspheres is 0.4 to 0.6 g/cm$^3$, and the average grain diameter of the hollow glass microspheres is 10 to 100 μm.

The organic silicon insulating coating layer 2 of the embodiments of the present invention is formed by the organic silicon insulating coating capable of being cured at room temperature. The organic silicon insulating coating layer 2 may be formed by applying the organic silicon insulating coating capable of being cured at room temperature to the exterior surface of the cable conductor 1 via coating or spraying in the form of liquid, and then curing the same over a certain time at room temperature. The embodiments of the present invention may be used for manufacturing a new insulated cable. In particular, the organic silicon insulating coating layer 2 may be formed at room temperature, and the embodiments of the present invention may be used for performing aerial coating on an overhead line exposed in the air which still operates currently, to achieve the insulation of the exposed overhead line. That is, the cable conductor 1 may be an exposed overhead bare conductive wire (overhead line). When the embodiments of the present invention are used to perform insulation processing on the exposed overhead line, an extruded telerobot for automatically spraying high-viscosity insulating varnish on overhead power line, disclosed in Patent No. 201310662729.0 applied by Changzhou Hanqing Electromechanical Technology Co., Ltd. on Dec. 9, 2013, may be used to conduct automatic spraying operation.

For example, when the automatic coating device is used, a device carrying liquid organic silicon insulating coating capable of being cured at room temperature, such as product 526 manufactured by 3M Company, can be hung on an overhead line, and then the device is started to enable the same to go forward at a constant speed along the overhead line and to ensure the device travels in the direction of the overhead line under the action of power. A wireless receiving device thereof can receive a transmitted signal over a long distance, such that operators can remotely operate and control the device. A discharging die head of the device is closed around the overhead line, and the distance between the diameter of the die head and the diameter of the overhead line can decide the thickness of the organic silicon insulating coating layer 2. So, the coating is evenly coated to the overhead line and a coating layer of certain thickness, such as about 2 mm, is formed. The thickness of the coating layer may need to be adjusted on the device based on insulation voltage requirements. The recommended thickness for the coating layer of a traditional 10 KV insulated overhead line is 2.0 to 2.5 mm. Certainly, the organic silicon insulating coating layer 2 also can be obtained in other construction manners, as long as an even coating layer can be finally formed on the surface of the exposed overhead line.

Thus, the embodiments of the present invention provide an insulated cable simple and rapid in construction and moderate in costs, which can solve the problems of long construction time and costly human and material resources invested in the process of removing an old line and replacing with a new line.

The following test has been conducted on the electric power cable 10 with the organic silicon insulating coating layer 2 having a thickness of 2 mm which is formed by the above-mentioned method using 3M 526 as the organic silicon insulating coating.

Alternating voltage test:

1. At room temperature, immerse a coated insulated overhead line in water for 1 hour, and then apply 12 KV experiment voltage for 1 minute. No breakdown on an insulated overhead line.

2. At room temperature, immerse the coated insulated overhead line in water and then continuously apply 12 KV experiment voltage. No breakdown on the insulated overhead line.

| | Alternating Voltage Test | |
|---|---|---|
| Test Items | 1 min @ 12 KV (after 1 hour for immersion in water) | Immerse in water for 4 hours at 12 KV |
| Test Results | PASS | PASS |

From the above test, the electric power cable provided by the embodiments of the present invention has the insulating property conforming to national mandatory requirements.

It may be understood that the above-mentioned embodiments are merely used to describe, but not limit, the present invention, and those skilled in the art may understand that the present invention can be modified and varied without departing from the scope and spirit of the present invention. The above-mentioned modification and variation are regarded to be within the scope of the present invention and appended claims. The protection scope of the present invention is provided by the appended claims. In addition, any drawing reference in the claims should not be understood as the limitation to the present invention. The verb "comprise" and its variations do not exclude the emergence of other elements or steps beyond the statement of the claims. The indefinite article "a" or "an" in front of one element or step does not exclude the emergence of a plurality of such elements or steps.

The invention claimed is:

1. An electric power cable, comprising a field applied organic silicon insulating coating layer curable at room temperature directly coated onto a conductor of the power cable, wherein said electric power cable comprises a cable conductor capable of transmitting electric energy, and said organic silicon insulating coating layer is coated to the exterior surface of said cable conductor, and wherein said cable conductor is an exposed overhead bare conductive wire.

2. An electric power cable according to claim 1, which is characterized in that the thickness of said organic silicon insulating coating layer is 1.5 to 3.0 mm.

3. An electric power cable according to claim 1, which is characterized in that the thickness of said organic silicon insulating coating layer is 2.0 to 2.5 mm.

4. An electric power cable according to claim 1, which is characterized in that said organic silicon insulating coating layer is an organic silicon insulating coating layer containing hollow glass microspheres.

5. An electric power cable according to claim 1, which is characterized in that said hollow glass microspheres account for 25% to 45% of the total weight of an organic silicon insulating coating layer.

6. An electric power cable according to claim 1, which is characterized in that said hollow glass microspheres account for 30% to 40% of the total weight of an organic silicon insulating coating layer.

7. An electric power cable according to claim 1, which is characterized in that the density of said hollow glass microspheres is 0.4 to 0.6 g/cm3.

8. An electric power cable according to claim 1, which is characterized in that the average grain diameter of said hollow glass microspheres is 10 to 100 μm.

9. The electric power cable of claim 1, wherein the field applied organic silicon coating is applied via spray coating.

10. A method of coating an electric power cable, comprising:

providing a field applied organic silicon insulating coating layer curable at room temperature, and coating the organic silicon insulating coating layer curable at room temperature onto an exposed overhead bare wire conductor.

11. The method of claim 10, wherein the field applied organic silicon insulating coating layer curable at room temperature comprises a liquid.

12. The method of claim 10, wherein the coating step comprises spraying the exposed overhead line with a spraying device.

13. The method according to claim 12, wherein the spraying device is a robotic spraying device.

14. The method of claim 13, wherein the coating is applied with an even thickness around a diameter of the overhead conductor.

15. The method of claim 14, wherein the thickness of the coating is about 2 mm to about 2.5 mm.

* * * * *